US005087025A

United States Patent [19]

Hamada

[11] Patent Number: 5,087,025

[45] Date of Patent: Feb. 11, 1992

[54] SHEET DELIVERY MECHANISM HAVING A SUCTION FEEDER INCLUDING A MOVABLE ROLLER PAIR

[75] Inventor: Shingo Hamada, Kanagawa, Japan

[73] Assignee: Fuji Photo Film Co., Ltd., Kanagawa, Japan

[21] Appl. No.: 639,402

[22] Filed: Jan. 10, 1991

Related U.S. Application Data

[63] Continuation of Ser. No. 325,407, Mar. 17, 1989, abandoned.

[30] Foreign Application Priority Data

Mar. 18, 1988 [JP] Japan ..... 63-65061

[51] Int. Cl.[5] ..... B65H 5/10

[52] U.S. Cl. ..... 271/14; 271/90; 271/268; 271/274

[58] Field of Search ..... 271/5, 11, 12, 14, 42, 271/95, 107, 114, 117, 118, 264, 267, 268, 272-274, 90

[56] References Cited

U.S. PATENT DOCUMENTS

| | | | |
|---|---|---|---|
| 3,740,029 | 6/1973 | Bays | 271/11 |
| 3,767,185 | 10/1973 | Newsome | 271/11 |
| 4,021,030 | 5/1977 | Fichte et al. | 271/11 |
| 4,369,962 | 1/1983 | Spiro | 271/11 |
| 4,759,679 | 7/1988 | Muller | 271/5 X |
| 4,767,113 | 8/1988 | Hasegawa et al. | 271/5 X |
| 4,848,764 | 7/1989 | Tajima et al. | 271/107 |
| 4,848,765 | 7/1989 | Torii | 271/274 |

FOREIGN PATENT DOCUMENTS

| | | | |
|---|---|---|---|
| 0242144 | 12/1985 | Japan | 271/11 |
| 0242840 | 10/1988 | Japan | 271/11 |
| 0252840 | 10/1988 | Japan | 271/5 |
| 258339 | 10/1988 | Japan | 271/274 |
| 0104534 | 4/1989 | Japan | 271/11 |
| 665513 | 1/1952 | United Kingdom | 271/12 |

*Primary Examiner*—Robert P. Olszewski
*Assistant Examiner*—Boris Milef
*Attorney, Agent, or Firm*—Sughrue, Mion, Zinn, Macpeak & Seas

[57] ABSTRACT

A sheet delivery mechanism for delivering a sheet such as a stimulable phosphor sheet from a sheet storage unit such as a cassette or a magazine to a sheet feed system, includes suction cups movable toward and away from the sheet stored in the sheet storage unit for removing an end of the sheet from the sheet storage unit, and a feed roller pair movably disposed between the suction cups and the sheet feed system, the feed roller pair being movable toward the suction cups for holding the end of the sheet removed from the sheet storage unit, and then operable to feed the sheet to the sheet feed system.

8 Claims, 5 Drawing Sheets

SHEET DELIVERY MECHANISM HAVING A SUCTION FEEDER INCLUDING A MOVABLE ROLLER PAIR

This is a continuation of application Ser. No. 07/325,407 filed Mar. 17, 1989, now abandoned.

BACKGROUND OF THE INVENTION

The present invention relates to a sheet delivery mechanism, and more particularly to a sheet delivery mechanism including suction means such suction cups or the like displaceable to attract a sheet such as a stimulable phosphor sheet, and a feed roller pair displaceable toward the sheet to receive the sheet from the suction means, so that the sheet can reliably be picked up or delivered from a cassette or a magazine simply by displacing the suction means and the roller pair.

There has recently been known a radiation image information recording and reproducing system for producing the radiation-transmitted image of an object using a stimulable phosphor material capable of emitting light upon exposure to stimulating rays. When a certain phosphor is exposed to a radiation such as X-rays, $\alpha$-rays, $\beta$-rays, $\gamma$-rays, cathode rays, or ultraviolet rays, the phosphor stores a part of the energy of the radiation. When the phosphor exposed to the radiation is subsequently exposed to stimulating rays such as visible light, the phosphor emits light in proportion to the stored energy of the radiation. The phosphor exhibiting such a property is referred to as a "stimulable phosphor".

In the radiation image recording and reproducing system employing such a stimulable phosphor, the radiation image information of an object such as a human body is stored in a sheet having a layer of stimulable phosphor, and then the stimulable phosphor sheet is scanned with stimulating rays such as a laser beam to cause the stimulable phosphor sheet to emit light representative of the radiation image. The emitted light is then photoelectrically detected to produce an image information signal that is electrically processed for generating image information which is recorded as a visible image on a recording medium such as a photosensitive material or displayed as a visible image on a CRT or the like.

The radiation image recorded on the stimulable phosphor sheet is read in the radiation image recording and reproducing system as follows:

The radiation image recording and reproducing system includes an image reader for two-dimensionally scanning the stimulable phosphor sheet with a light beam such as a laser beam to cause the stimulable phosphor sheet to emit light, and detecting the light in time series with a light detector such as a photomultiplier to obtain image information. The stimulable phosphor sheet is usually two-dimensionally scanned by mechanically feeding the stimulable phosphor sheet in an auxiliary scanning direction, and simultaneously deflecting the light beam and applying the deflected light beam to the stimulable phosphor sheet in a main scanning direction substantially normal to the auxiliary scanning direction.

An object to be imaged is exposed to radiation, which passes through the object to record a radiation image of the object on a stimulable phosphor sheet stored in a cassette. The cassette storing the stimulable phosphor sheet is then loaded into an image reader, and then the stimulable phosphor sheet is removed from the cassette by a sheet delivery mechanism including a suction cup and fed to a scanning position in which the stimulable phosphor sheet is two-dimensionally scanned by a light beam.

One general arrangement of such a cassette is illustrated in FIG. 1 of the accompanying drawings.

As shown in FIG. 1, a cassette 2 comprises a casing defining a chamber 4 for storing a stimulable phosphor sheet S therein, and a lid 10 swingably mounted on one end of the casing 6 by means of a hinge 8.

The cassette 2 with the stimulable phosphor sheet S stored therein is loaded into an image reader 12, for example. The lid 10 is opened by a suction cup 14 in the image reader 12 to open the chamber 4 in the image reader 2. Then, a sheet delivery mechanism including a suction cup 16 is operated to attract the stimulable phosphor sheet S in the casing 6 and, the attracted stimulable phosphor sheet S is fed to a scanning reading unit through a feed mechanism (not shown).

When the stimulable phosphor sheet S is to be picked up from the cassette 2, the stimulable phosphor sheet has to be removed, as if fanned, by the sheet delivery mechanism in order to prevent the stimulable phosphor sheet S from engaging a front wall 6a of the casing 6. The sheet delivery mechanism is therefore considerably complex in structure in order to cause the suction cup 16 to move along a path for giving a desired removing or fanning action to the stimulable phosphor sheet S.

SUMMARY OF THE INVENTION

It is a primary object of the present invention to provide a sheet delivery mechanism including a suction means movable along a substantially straight path for attracting a stimulable phosphor sheet, and a feed roller pair disposed between the suction means and a sheet feed system for back-and-forth movement, the suction means being operable to attract and remove the stimulable phosphor sheet from a cassette and thereafter the feed roller pair being displaceable toward the suction means to grip the stimulable phosphor sheet and deliver the stimulable phosphor sheet to the feed system, so that the displacement of the suction means and the feed roller pair is simplified and hence the stimulable phosphor sheet can reliably be delivered with a simple structure.

Another object of the present invention is to provide a sheet delivery mechanism for delivering a sheet from a sheet storage unit to a sheet feed system, comprising: suction means movable toward and away from the sheet stored in the sheet storage unit for removing an end of the sheet from the sheet storage unit; and feed means movably disposed between said suction means and the sheet feed system, said feed means being movable toward said suction means for holding the end of the sheet removed from sad sheet storage unit, and then operable to feed the sheet to said sheet feed system.

Still another object of the present invention is to provide a sheet delivery mechanism wherein said suction means comprises at least one suction cup connected to a vacuum generator, an arm supporting said suction cup, first and second guide pins mounted on said arm, means defining guide grooves in which said first and second guide pins are movably fitted respectively, a guide plate engaging said first guide pin, and an actuator for rotating said guide plate.

Yet another object of the present invention is to provide a sheet delivery mechanism wherein said actuator comprises a rotative drive source and a gear coupled to said rotative drive source, said guide plate having gear teeth meshing with said gear and a guide slot in which said first guide pin is movably fitted.

Yet still another object of the present invention is to provide a sheet delivery mechanism wherein said feed means comprises an actuator and a feed roller pair comprising a driver roller rotatable by said actuator, a nip roller engageable with said driver roller, and a resilient member acting between said driver and nip rollers for normally urging the driver and nip rollers to be held in rolling contact with each other.

A further object of the present invention is to provide a sheet delivery mechanism further including an actuator for moving said feed means back and forth between said suction means and said sheet feed system.

A still further object of the present invention is to provide a sheet delivery mechanism wherein said last-mentioned actuator comprises a cylinder.

A yet further object of the present invention is to provide a sheet delivery mechanism wherein said last-mentioned actuator comprises a rotative drive source, a disc rotatable by said rotative drive source, a link having an end connected eccentrically to said disc, and a rod supporting said feed means and coupled to an opposite end of said link.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
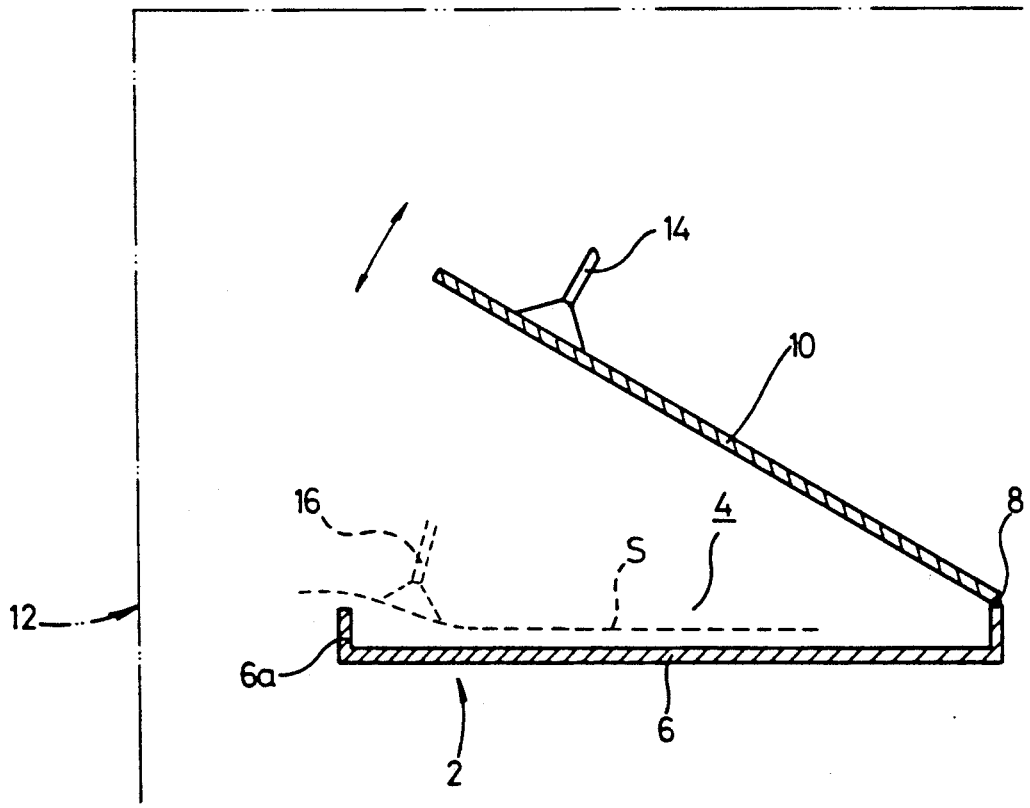
FIG. 1 is a schematic cross-sectional view of a conventional sheet delivery mechanism.
Figure 2:
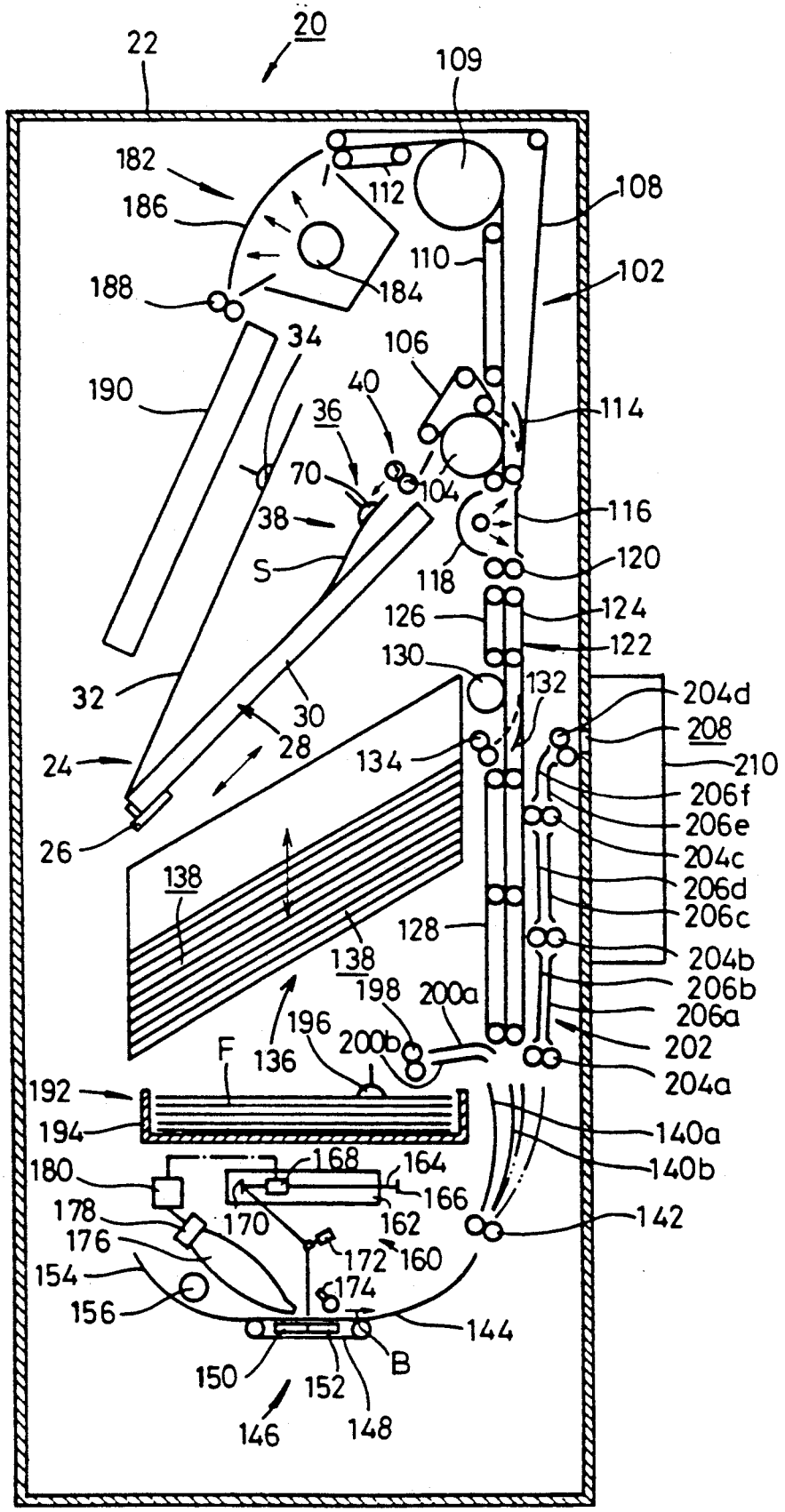
FIG. 2 is a schematic elevational view of an image reading and reproducing system incorporating a sheet delivery mechanism according to the present invention.

FIG. 2 shows an image reading and reproducing system, generally designated by the reference numeral 20, which incorporates therein a sheet delivery mechanism according to the present invention. The image reading and reproducing system 20 includes a vertically elongate housing 22 having a first loading unit 24. The first loading unit 24 has a movable base 26 which is movable back and forth in the directions indicated by the arrow, and a cassette 28 detachably mounted on the movable base 26. The cassette 28 includes a casing 30 for storing a stimulable phosphor sheet S and a lid 32 openably and closably supported on one end of the casing 30. The lid 32 can be opened and closed by a lid opening mechanism including a suction cup 34 movably disposed in the housing 22. The stimulable phosphor sheet S can be delivered or removed from the cassette 28 by means of a sheet delivery mechanism 36 of the present invention which is located near the suction cup 34.

Figure 3:
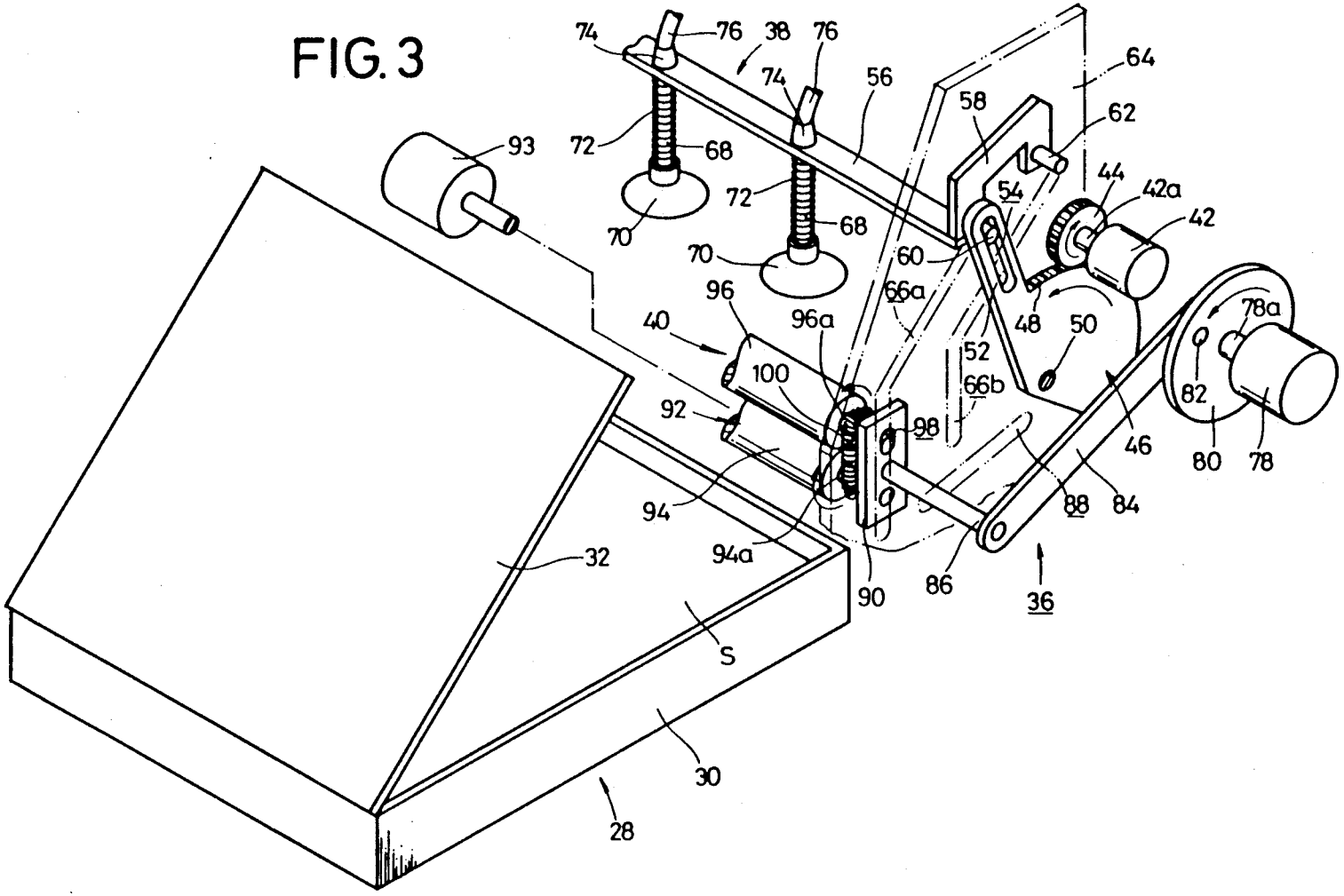
FIG. 3 is a fragmentary perspective view of the sheet delivery mechanism of the present invention.

As shown in FIG. 3, the sheet delivery mechanism 36 basically comprises a suction means 38 for attracting the stimulable phosphor sheet S stored in the casing 30 and removing the stimulable phosphor sheet S from the casing 30, and a feed means 40 for gripping the removed stimulable phosphor sheet S and delivering the stimulable phosphor sheet S to a feed system (described below).

The suction means 38 includes a first rotative drive source 42 having a rotatable shaft 42*a* on which a gear 44 is mounted. The gear 44 is in mesh with a substantially arcuate row of gear teeth 48 on a guide plate 46 which is angularly movably supported in the housing 22 by a rod 50 secured to the guide plate 46 at the center about which the gear teeth 48 are angularly movable. A holder 52 projects radially outwardly from one end of the row of gear teeth 48 in a direction away from the rod 50, the holder 52 having a radial slot 54 defined therein.

An arm 56 engaging the guide plate 46 has a bent support 58 on one end thereof, with first and second parallel guide pins 60, 62 attached to the support 58. A wall plate 64 is vertically disposed in the housing 22 and has two bent guide grooves 66*a*, 66*b* extending downwardly. The first and second guide pins 60, 62 are movably inserted respectively in the guide grooves 66*a*, 66*b*, the first guide pin 6 extending also into the slot 54 in the holder 52. The other end (not shown) of the arm 56 is of a similar structure A plurality of tubes 68 are slidably fitted in the arm 56 at spaced intervals, and suction cups 70 are mounted on lower ends of the tubes 68. Coil springs 72 are interposed around the respective tubes 68 between the suction cups 70 and the arm 56. The upper ends of the tubes 68 have engaging members 74 engaging the arm 56 and connected to ends of tubes 76 which are coupled at the other ends to a vacuum generator (not shown).

The feed means 40 includes a second rotative drive source 78 having a rotatable shaft 78*a* on which a disc 80 of a relatively large diameter is mounted. An elongate link 84 has one end coupled to an outer peripheral edge of the disc 80 by means of a pin 82 and the other end connected to a rod 86. The rod 86 extends through a guide slot 88 defined in the wall plate 76 or another wall plate different from the wall plate 76 and extending substantially perpendicularly to the guide slots 66*a*, 66*b*, and has an end fixed to an attachment plate 90 which supports a roller pair 92.

The roller pair 92 includes a driver roller 94 rotatable by a rotative drive source 93 and a nip roller 96 rollingly held in contact with the driver roller 94. The driver roller 94 has a shaft 94*a* extending from one end thereof and rotatably supported on the attachment plate 90. The nip roller 96 has a shaft 96*a* extending from one end thereof and fitted in a vertical slot 98 defined in the attachment plate 90. A spring 100 is disposed under tension around the shafts 96*a*, 94*a*. The other ends of the driver and nip rollers 94, 96 are similar in structure to the shafts 94*a*, 96*a*. The rotative drive source 93 is operatively coupled to a shaft (not shown) of the driver roller 94 through a belt and pulley means, for example, including an idler pulley.

The stimulable phosphor sheet S delivered by the sheet delivery mechanism 36 is supplied to a first feed system 102. The first feed system 102 comprises a larger-diameter drum 104, a first feed belt 106 held in contact with the drum 104, and a second feed belt 108 held in contact with the drum 104. The first feed belt 106 is trained around three rollers and has a portion held against the drum 104. The second feed belt 108 extends vertically upwardly out of contact with the drum 104, and is bent substantially perpendicularly so as to extend substantially horizontally along an inner surface of an upper pane of the housing 22. The second feed belt 108 remains bent around a larger-diameter roller 109. A third feed belt 110 is disposed in against a vertical run of the second feed belt 108, and a fourth feed belt 11 is disposed underneath and in contact with a horizontal run of the second feed belt 108. A first switching guide member 114 is disposed in an area where the second feed belt 108 and the drum 104 are held against each other. A guide plate 116 is positioned below the first feed system 102, and an auxiliary eraser unit 118 is disposed in confronting relation to the guide plate 116. A roller pair 120 is positioned near the lower end of the guide plate 116, and a second feed system 122 extends downwardly from the roller pair 120.

The second feed system 122 comprises a relatively long fifth feed belt 124 extending vertically downwardly, a relatively short sixth feed belt 126 held in contact with an upper portion of the fifth feed belt 124, and a seventh feed belt 128 held against a lower portion of the fifth feed belt 124. A roller 130 of a relatively large diameter is held in rolling contact with an intermediate portion of the fifth feed belt 124. A second switching guide member 132 is positioned near the roller 130. The second switching guide member 132 can be angularly displaced into a broken-line position to position its tip end near a roller pair 134. A stimulable phosphor sheet S which has been fed by the second feed system 122 can be introduced into a stacker 136 by the roller pair 134.

The stacker 136 is movable vertically by a motor or the like (not shown). The stacker 136 can store a stimulable phosphor sheet S fed by the roller pair 134 into a desired one of an array of juxtaposed sheet bins 138. The stimulable phosphor sheet S stored in the stacker 136 is then fed to the second feed system 122 by the roller pair 134.

The stimulable phosphor sheet S fed by the second feed system 122 is supplied into a position between a pair of movable guide plates 140*a*, 140*b* disposed below the second feed system 122, and is thereafter gripped by a roller pair 142 positioned beneath the movable guide plates 140*a*, 140*b*. A curved guide plate 144 is fixedly disposed below the roller pair 142, and an auxiliary scanning feed means 146 is located in the vicinity of the guide plate 144.

The auxiliary scanning feed means 146 comprises an auxiliary scanning endless feed belt 148 having a plurality of holes (not shown) defined therein, and first and second suction boxes 150, 152 disposed in the endless feed belt 14 for attracting a stimulable phosphor sheet S and a film F fed by the endless feed belt 148, under a vacuum applied through the holes of the feed belt 148. The first and second suction boxes 150, 152 are connected to a vacuum pump or the like (not shown). The auxiliary scanning feed belt 148 serves to feed the stimulable phosphor sheet S and the film F supplied through the guide plate 144 toward a guide plate 182, and to thereafter feed them in the opposite direction (indicated by the arrow B) for auxiliary scanning. A roller 156 is positioned near the guide plate 154 for preventing the stimulable phosphor sheet S and the film F from rising off the guide plate 154 due to flexing of the stimulable phosphor sheet S and the film F.

An image reading and recording mechanism 160 is positioned above the auxiliary scanning feed means 146 for reading image information recorded on the stimulable phosphor sheet S and exposing the film F to the image information thus read. The image reading and recording mechanism 160 includes a laser beam source 162 and a mirror 166 disposed on the laser beam emitting side of the laser beam source 162 for reflecting a laser beam 164 emitted from the laser beam source 162. The laser beam 164 reflected by the mirror 166 passes through a light modulator 168 toward another mirror 170. The light modulator 168 is energized only when an image is to be recorded on the film F, and not energized when an image is read from the stimulable phosphor sheet S. The image reading and recording mechanism 160 also includes a galvanometer mirror 172 and a light-collecting reflecting mirror 174 for scanning the stimulable phosphor sheet S with the laser beam 164 which has been reflected by the mirror 170.

A light guide 176 which extends along a main scanning line is positioned in the area where the stimulable phosphor sheet S is scanned by the laser beam 164, and a photomultiplier 178 is mounted on an upper end of the light guide 176. The photomultiplier 178 is electrically connected to an image information processing circuit 180. Therefore, an electric signal produced by the photomultiplier 178 is sent to the image information processing circuit 180 for image processing, and a processed image is stored in a memory means or the like.

The stimulable phosphor sheet S from which the image has been read by the image reading and recording mechanism 160 is then delivered through the second feed system 122 and the first feed system 102 to an eraser unit 182 which is positioned near the fourth feed belt 11 of the first feed system 102. The eraser unit 182 comprises an erasing light source 184 such as a sodium-vapor lamp, a tungsten lamp, or a xenon lamp, a guide panel 186 for guiding the the stimulable phosphor sheet S, and a roller pair 188 disposed beneath the guide panel 186. A tray 190 is positioned below the roller pair 188. When a sheet supply magazine storing a plurality of stimulable phosphor sheets S is loaded in the first loading unit 24, the tray 190 stores the stimulable phosphor sheets S after recorded images have been read from the stimulable phosphor sheets S fed from the sheet magazine and residual image information has been erased from the stimulable phosphor sheets S by the eraser unit 182.

A second loading unit 192 is disposed below the stacker 136 and includes a detachable magazine 194 which stores a stack of films F. A film delivery mechanism including a suction cup 196 is positioned near a film access opening of the magazine 194. The suction cup 196 serves to deliver one film F at a time from within the magazine 194 and supply the film F to a roller pair 198. A pair of guide plates 200*a*, 200*b* are positioned in confronting relation to and slightly spaced from the roller pair 198. The guide plates 200*a*, 200*b* serve to guide the film F supplied to the roller pair 198 into the position between the movable guide plates 140*a*, 140*b*.

A film feed path 202 is disposed near the movable guide plates 140*a*, 140*b* for feeding a film F on which a certain image has been reproduced by the image reading and recording mechanism 160. The film feed path 202 includes roller pairs 204*a* through 204*d* spaced at intervals, a pair of guide plates 206*a*. 206*b* disposed between the roller pairs 204*a*, 204*b*, a pair of guide plates 206*c*, 206*d* disposed between the roller pairs 204*b*, 204*c*, and a pair of curved guide plates 206*e*, 206*f* disposed between the roller pairs 204*c*, 204*d*. The roller pair 204*d* is positioned near an opening 208 defined in a side panel of the housing 22 of the image reading and reproducing system 20. The film F which is fed by the film feed path 202 is sent through the opening 208 into a receiver magazine 210 detachably mounted on the housing 22.

An automatic image developing device (not shown) may be paced adjacent to the housing 22, and the film F fed from the roller pair 204*d* may be delivered through the opening 208 into the automatic image developing device for automatically developing the image on the film F.

The image reading and reproducing system incorporating the sheet delivery mechanism of the invention is basically constructed as described above. Now, the stacker and the image reading and reproducing system will operate and offers advantages as follows:

The cassette 28 storing a stimulable phosphor sheet S is mounted on the movable base 26 of the first loading unit 26. Then, the movable base 26 is moved upwardly and rightwardly in FIG. 2 to position the upper portion of the cassette 28 in a prescribed location, and a lock means (not shown) on the lid 32 is released. The lid 32 of the cassette 28 is then opened by the suction cup 34 of the lid opening mechanism under a vacuum applied thereby, and thereafter the sheet delivery mechanism 36 is operated.

More specifically, as shown in FIG. 3, the first rotative drive source 42 is energized to rotate the shaft 42*a* in the direction indicated by the arrow to rotate the gear 44 in the same direction. The guide plate 46 is now angularly displaced in the direction of the arrow by the gear teeth 48 meshing with the gear 44. As the guide plate 46 is turned, the guide pin 60 inserted in the slot 54 of the guide plate 46 causes the arm 56 to be displaced toward the cassette casing 30 while being guided by the first guide pin 60 and the guide slot 66*a* in the wall plate 64. At this time, since the second guide pin 62 on the support 58 of the arm 56 is guided along the guide slot 66*b* in the wall plate 64, the arm 56 is prevented from being unnecessarily turned.

When the suction cups 70 supported on the arm 56 through the tubes 68 engage the stimulable phosphor sheet S upon such angular displacement of the arm 56, the vacuum generator is operated to enable the suction cups 70 to attract the stimulable phosphor sheet S. The first rotative drive source 42 is then reversed to rotate the shaft 42*a* and the gear 44 in the direction opposite to the direction indicated by the arrow. The guide plate 46 is then turned back about the rod 50 in the direction opposite to the direction of the arrow. Therefore, the arm 56 is displaced away from the cassette casing 30 while being guided by the first and second guide pins 60, 62 and the guide slots 66*a*, 66*b*. The leading end of the stimulable phosphor sheet S attracted to the suction cups 70 is now taken out of the cassette 30 upwardly thereof (see FIG. 4(*a*)).

Figure 4A:
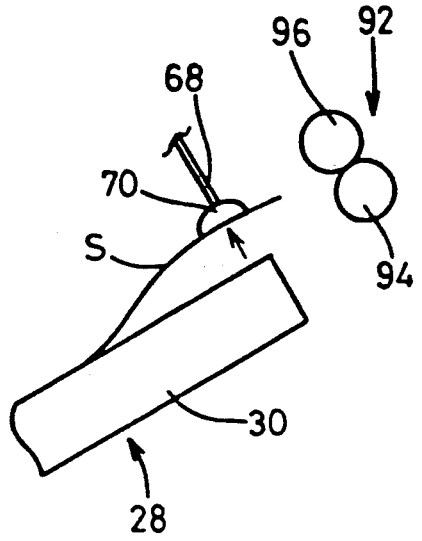
FIGS. 4(*a*) through 4(*c*) are fragmentary schematic views showing the manner in which a stimulable phosphor sheet is delivered from a cassette by the sheet delivery mechanism.
Figure 4B:
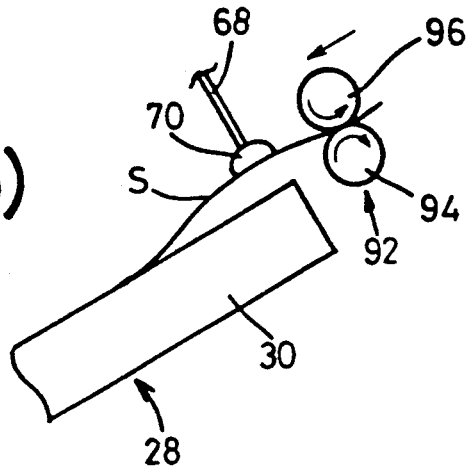
Figure 4C:
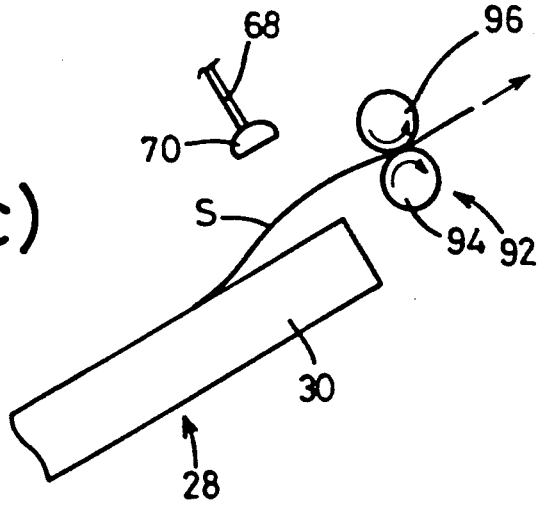

Then, the second rotative drive source 78 is energized to rotate the shaft 78*a* and the disc 80 in unison in the direction indicated by the arrow. The link 84 coupled to the disc 80 by the pin 82 is then displaced toward the cassette 28. The rod 86 connected to the end of the link 84 is moved toward the cassette 28 while being guided by the guide slot 88, thus moving the roller pair 92 supported o the attachment plate 90 coupled to the rod 86 toward the suction cups 70. With the rotative drive source 93 energized, at this time, the driver roller 94 is rotated through an angular interval corresponding to the distance by which the roller pair 92 moves toward the suction cups 70, as shown in FIG. 4(*b*)). Therefore, the roller pair 92 grips the leading end of the stimulable phosphor sheet S held by the suction cups 70 without damaging the stimulable phosphor sheet S. The vacuum generator is then inactivated to release the stimulable phosphor sheet S from the suction cups 70, whereupon the stimulable phosphor sheet S is held by only the roller pair 92.

The rotative drive source 93 is then energized to rotate the driver roller 94 in the direction of the arrow (FIG. 4(*c*)). The driver roller 94 and the nip roller 96 feed the stimulable phosphor sheet S to allow the same to be gripped between the first feed belt 106 and the drum 104 of the first feed system 102, by which the stimulable phosphor sheet S is then fed vertically downwardly.

After the stimulable phosphor sheet S has been fed downwardly by the drum 104 and the first feed belt 106 of the first feed system 102, the stimulable phosphor sheet S is supplied into a position between the fifth feed belt 124 and the sixth feed belt 126 of the second feed system 122, by which the stimulable phosphor sheet S is fed downwardly. At this time, the second switching guide member 132 is angularly displaced toward the broken-line position in FIG. 2, and the stimulable phosphor sheet S is stored into one sheet bin 138 in the stacker 136 by the roller pair 134.

Then, the stacker 136 is elevated or lowered to select a stimulable phosphor sheet S with certain image information recorded thereon, stored in the stacker 136. The selected stimulable phosphor sheet S is delivered through the roller pair 134 into the second feed system 122 by which the stimulable phosphor sheet S is then fed downwardly into the gap between the movable guide pates 140*a*, 140*b*. The stimulable phosphor sheet S taken out of the cassette 28 may directly be fed by the second feed system 122 into the gap between the movable guide plates 140*a*, 140*b*.

The stimulable phosphor sheet S supplied between the movable guide plates 140*a*, 140*b* is gripped and fed by the roller pair 142, and then fed into the auxiliary scanning feed means 146 through the guide plate 144. In the auxiliary scanning feed means 146, the stimulable phosphor sheet S is fed in the direction opposite to the direction of the arrow B by the auxiliary scanning feed belt 148 until it is placed onto the guide plate 154. When the trailing end of the stimulable phosphor sheet S has moved past the scanning area of the image reading and recording mechanism 160, the auxiliary scanning feed belt 148 is moved in the opposite direction to displace the stimulable phosphor sheet S in the auxiliary scanning direction indicated by the arrow B. At this time, the non-illustrated vacuum pump is actuated to attract the stimulable phosphor sheet S against the auxiliary scanning feed belt 148 through the first and second suction boxes 150, 152.

While the stimulable phosphor sheet S is being fed as indicated by the arrow B, the image reading and recording mechanism 160 is energized to enable the laser beam source 162 to emit the laser beam 164. The laser beam 164 is reflected by the mirrors 166, 170 toward the galvanometer mirror 172, which is periodically swung back and forth to deflect and scan the laser beam 164 over the stimulable phosphor sheet S in the main scanning direction. At this time, the light modulator 200 is not energized since it is used for recording an image. Light emitted from the stimulable phosphor sheet S upon exposure to the laser beam 164 is applied directly or via the reflecting mirror 174 to the light guide 176. The photomultiplier 178 then converts the light from the light guide 176 into an electric signal that is supplied to the image information processing circuit 180. The stimulable phosphor sheet S is thus two-dimensionally scanned by the laser beam 164.

After the image has been read, the stimulable phosphor sheet S is delivered by the roller pair 142 to the second feed system 122, and then fed upwardly and then horizontally into the eraser unit 182 by the roller pair 120 and the first feed system 102. In the eraser unit 182, light emitted from the erasing light source 184 erases any residual image information on the stimulable phosphor sheet S.

The stimulable phosphor sheet S from which residual image information has been eliminated by the eraser unit 182 is fed downwardly again by the first feed system 102 into the second feed system 122. The second switching guide member 132 of the second feed system 122 is turned to the broken-line position to guide the stimulable phosphor sheet S into a selected sheet bin 138 in the stacker 136 through the roller pair 134. However, the stimulable phosphor sheet S from the eraser unit 182 may not be stored into the stacker 136, but may be gripped by the fifth feed belt 124 and the sixth feed belt 126 and fed backwards directly into the cassette 28. When a magazine is loaded in the first loading unit 24, the stimulable phosphor sheet S from which the image information has been erased is stored into the tray 190 disposed below the eraser unit 182.

The cassette 28 from which the stimulable phosphor sheet S has been removed is then supplied with a stimulable phosphor sheet S with image information erased therefrom which has been stored in a sheet bin 138 in the stacker 136. More specifically, the stacker 136 is displaced vertically to select the stimulable phosphor sheet S with image information erased therefrom, and the selected stimulable phosphor sheet S is gripped by the roller pair 134 and fed to the second feed system 122. The second feed system 122 delivers the stimulable phosphor sheet S upwardly into the first feed system 102 through the roller pair 120. At the same time, the first switching guide member 114 is angularly displaced toward the broken-line position in FIG. 2. Therefore, the stimulable phosphor sheet S is guided by the first switching guide member 114 and fed by the first feed belt 106 into the sheet delivery mechanism 36.

As illustrated in FIG. 3, the rotative drive source 93 is energized to rotate the driver roller 94 in the direction opposite to the direction indicated by the arrow. The nip roller 96 held against the driver roller 94 is rotated in the direction opposite to the direction indicated by the arrow. The leading end of the stimulable phosphor sheet S fed toward the roller pair 92 is now gripped by the roller pair 92. The second rotative drive source 78 is also energized to rotate the shaft 78*a* and the disc 80 in unison to cause the link 84 to move the rod 86 toward the cassette casing 30 along the guide slot 88. The roller pair 92 supported on the attachment plate 90 fixed to the rod 86 is then moved toward the cassette casing 30. The stimulable phosphor sheet S gripped by the roller pair 92 is now reliably stored back into the cassette casing 30 of the cassette 28. Immediately before the stimulable phosphor sheet S is placed into the cassette casing 30, any remaining image information on the stimulable phosphor sheet S has been completely erased by the auxiliary eraser unit 118.

After the stimulable phosphor sheet S has been fed into the cassette casing 30, the second rotative drive source 78 is energized again to move the roller pair 92 away from the cassette casing 30, and the lid opening mechanism including the suction cup 34 is operated to displace the suction cup 34 toward the cassette casing 30 to close the lid 32. Then, the movable base 26 is moved downwardly and leftwardly in FIG. 2 to remove the cassette 28 from the first loading unit 24, after which a cassette storing a stimulable phosphor sheet S with other image information recorded thereon is loaded into the first loading unit 24.

When the stimulable phosphor sheet S is fed from the auxiliary scanning feed means 146 into the second feed system 122 by the roller pair 142, the film delivery mechanism disposed near the second loading unit 192 is operate to enable the suction cup 196 to pick up and remove the uppermost one of stacked films F in the magazine 194. The film F removed by the suction cup 196 is gripped by the roller pair 198, which is then rotated to feed the film F into the position between the movable guide plates 140*a*, 140*b* through the guide plates 200*a*, 200*b* by the roller pair 198. The film F is then gripped and fed by the roller pair 142 in the same manner as the stimulable phosphor sheet S was gripped and fed, into the auxiliary scanning feed means 146. The film F is fed in the direction opposite to the direction of the arrow B by the auxiliary scanning feed belt 148 until the stimulable phosphor sheet S is placed onto the guide plate 154. Then, the film F is fed in the direction indicated by the arrow B by reversing the direction of movement of the auxiliary scanning feed belt 148. During this time, the film F is attracted to the auxiliary scanning feed belt 148 under a vacuum applied through the suction boxes 150, 152.

When the film F is fed in the direction indicated by the arrow B, the image reading and recording mechanism 160 is energized again. More specifically, the laser beam 164 is emitted from the laser beam source 162 and reflected by the mirror 166 to reach the light modulator 168. The light modulator 168 is supplied with image signal data from the stimulable phosphor sheet S which have been processed by the image information processing circuit 180 and stored in a memory means (not shown). Therefore, the laser beam 164 which has reached the light modulator 168 has been modulated by the image signal data. The modulated laser beam 164 is reflected by the mirror 170 to reach the galvanometer mirror 172, which is swung back and forth to deflect the laser beam 164 in the main scanning direction while applying the laser beam 164 to the film F.

While the film F is being bed in the auxiliary scanning direction (indicated by the arrow B), it is scanned by the laser beam 164 in the main scanning direction. Therefore, the film F is two-dimensionally exposed to the image which has been read from the stimulable phosphor sheet S to reproduce the image on the film F. While the image is being reproduced on the film F, the photomultiplier 178 is de-energized.

After the image has been reproduced, the film F is fed from the auxiliary scanning feed means 146 into the position between the movable guide plates 140*a*, 140*b* through the guide plate 144 and the roller pair 142. The movable guide plates 140*a*, 140*b* are turned to the two-dot-and-dash-line position to feed the stimulable phosphor sheet S into the film feed path 202. The film F is guided by the roller pairs 204*a* through 204*d* and the guide plates 206*a* through 206*f* and supplied through the opening 208 into the receiver magazine 210. After a predetermined number of films F have been stored in the receiver magazine 210, the receiver magazine 210 is removed from the housing 22 in a light-shielded condition, and then the films F are loaded into an image developing device (not shown) to develop the images on the films F.

In the foregoing embodiment, the stimulable phosphor sheet S stored in the cassette 28 can reliably fed into the first feed system 102 through a simple arrangement.

More specifically, the sheet delivery mechanism 36 is substantially composed of the suction means 38 movable along a substantially straight path toward and away from the stimulable phosphor sheet S stored in the cassette casing 30, and the feed means 40 disposed between the suction means 38 and the first feed system 102 and movable back and forth in directions substantially normal to the directions in which the suction means 38 is movable. In operation, the guide plate 46 is angularly displaced by the first rotative drive source 42 to cause the arm 56 to displace the suction cups 70 into a position to attract the stimulable phosphor sheet S, and then to displace the suction cups 70 to remove the leading end of the stimulable phosphor sheet S from the cassette casing 30 (see FIG. 4(*a*)). Then, the roller pair 92 is displaced toward the suction cups 70 by the second rotative drive source 78, and the driver roller 94 and nip roller 96 of the roller pair 92 are rotated in the directions of the arrows in FIG. 4(*b*) in response to the displacement of the roller pair 92. The leading end of the stimulable phosphor sheet S attracted by the suction cups 70 is now gripped by the roller par 92. After the vacuum generator (not shown) has been inactivated, the roller pair 92 is rotated in the directions of the arrows in FIG. 4(*c*) to deliver the stimulable phosphor sheet S toward the first feed system 102.

The sheet delivery mechanism 36 can thus displace the suction cups 70 toward and away from the cassette casing 30, and also displace the roller pair 92 toward and away from the suction cups 70 for enabling the roller pair 92 to reliably grip the stimulable phosphor sheet S without damaging the stimulable phosphor sheet S.

Figure 5:
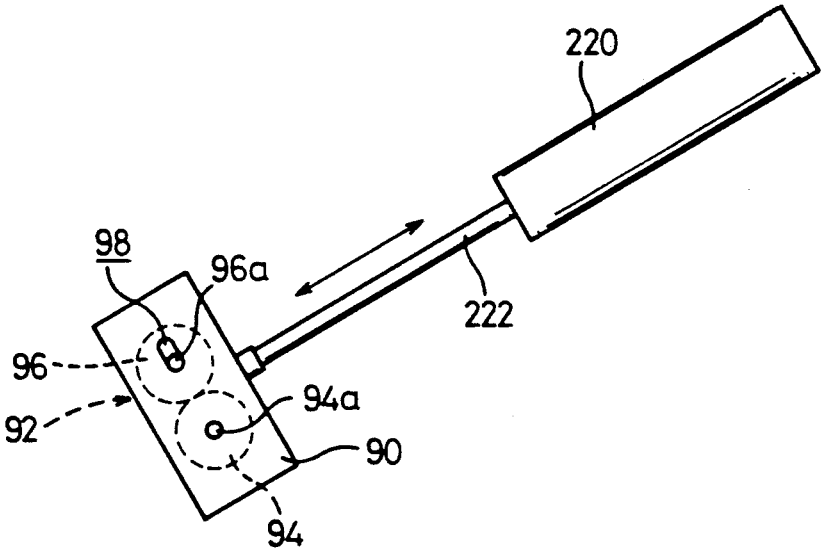
FIG. 5 is a schematic view of a feed means according to another embodiment for use in a sheet delivery mechanism.

Since the roller pair 92 is required to travel back and forth along a substantially straight path, the feed means 40 may be a linear actuator such as a cylinder. FIG. 5 shows such a feed means according to another embodiment of the present invention. A piston rod 222 extending from a cylinder 220 is connected to the attachment plate 90. Therefore, the roller pair 92 can be displaced back and forth by the cylinder 220 through the attachment plate 90.

With the present invention, as described above, by displacing a feed roller pair toward a suction means while attracting a sheet such as a stimulable phosphor sheet with the suction means, the sheet can be transferred from the suction means to the feed roller pair without damaging the surface of the sheet.

Inasmuch as the suction means including suction cups is required to be capable of only attracting the sheet, the path of the suction means is greatly simplified. As a result, the sheet delivery mechanism of the invention is simple in structure, and can be manufactured economically.

Although certain preferred embodiments have been shown and described, it should be understood that many changes and modifications may be made therein without departing from the scope of the appended claims.

What is claimed is:

1. A sheet delivery mechanism for delivering a sheet from a sheet storage unit to a sheet fed system, comprising:

suction means movable toward and away from the sheet stored in the sheet storage unit for removing an end of the sheet from the sheet storage unit; and feed means movably disposed between said suction means and the sheet feed system, said feed means being movable toward said suction means for holding the end of the sheet removed from said sheet storage unit, and then operable to feed the sheet to said sheet feed system, said feed means being displaceable between said suction means and said sheet feed system while holding said end of said removed sheet, wherein said suction means comprises at least one suction cup connected to a vacuum generator, an arm supporting said suction cup, first and second guide pins mounted on said arm, means defining guide grooves in which said first and second guide pins are movably fitted respectively, a guide plate engaging said first guide pin, and a first actuator for rotating said guide plate.

2. A sheet delivery mechanism according to claim 1, wherein said first actuator comprises a first rotative drive source and a gear coupled to said first rotative drive source, said guide plate having gear teeth meshing with said gear and a guide slot in which said first guide pin is movably fitted, said first rotative drive source enabling the movement of said suction means, toward or away from said sheet storage unit.

3. A sheet delivery mechanism according to claim 1, further comprising a second actuator for moving said feed means back and forth between said suction means and said sheet feed system.

4. A sheet delivery mechanism according to claim 3, wherein said second actuator comprises a second rotative drive source, a disc rotatable by said second rotative drive source, a link having an end connected eccentrically to said disc, and a rod supporting said feed means and coupled to an opposite end of said link.

5. A sheet delivery mechanism according to claim 3, wherein said feed means comprises a third rotative drive source and a feed roller pair comprising a driver roller rotatable by said third rotative drive source, a nip roller engageable with said driver roller, and a resilient member acting between said driver and nip rollers for normally urging the driver and nip rollers to be held in rolling contact with each other.

6. A sheet delivery mechanism according to claim 1, wherein said sheet comprises a stimulable phosphor sheet.

7. A sheet delivery mechanism for delivering a sheet from a sheet storage unit to a sheet feed system, comprising:

suction means movable toward and away from the sheet stored in the sheet storage unit for removing an end of the sheet from the sheet storage unit; and feed means movably disposed between said suction means and the sheet feed system, said feed means being movable toward said suction means for holding the end of the sheet removed from said sheet storage unit, and then operable to feed the sheet to said sheet feed system, said feed means being displaceable between said suction means and said sheet feed system while holding said end of said removed sheet, wherein said suction means comprises at least one suction cup connected to a vacuum generator, an arm supporting said suction cup, first and second guide pins mounted on said arm, means defining guide grooves in which said first and second guide pins are movable fitted respectively, a guide plate engaging said first guide pin, and an actuator for rotating said guide plate, and wherein said feed means comprises a rotative drive source and a feed roller pair comprising a driver roller rotatable by said rotative drive source, a nip roller engageable with said driver roller, and a resilient member acting between said driver and nip rollers for normally urging the driver and nip rollers to be held in continuous rolling contact with each other.

8. A sheet delivery mechanism for delivering a sheet from a sheet storage unit to a sheet feed system, comprising:

a sheet storage unit having a casing defining a chamber for storing a stimulable phosphor sheet therein, and a lid swingably mounted on one end of the casing by means of a hinge;

suction means movable toward and away from the sheet stored in the sheet storage unit for removing an end of the sheet from the sheet storage unit; and feed means movably disposed between said suction means and the sheet feed system, said feed means being movable toward said suction means for holding the end of the sheet removed from said sheet storage unit, and then operable to feed the sheet to said sheet feed system, said feed means being displaceable between said suction means and said feed system while holding said removed sheet, wherein said suction means comprises at least one suction cup connected to a vacuum generator, an arm supporting said suction cup, first and second guide pins mounted on said arm, means defining guide grooves in which said first and second guide pins are movably fitted respectively, a rotatable guide plate engaging said first guide pin, and an actuator for rotating said guide plate.

* * * * *